United States Patent [19]

Dauman

[11] 4,386,710

[45] Jun. 7, 1983

[54] COMBINATION POINT-OF-SALE DISPLAY AND DISPENSER DEVICE

[75] Inventor: Sidney M. Dauman, Beverly Hills, Calif.

[73] Assignee: Dauman Displays, Inc., New York, N.Y.

[21] Appl. No.: 301,318

[22] Filed: Sep. 11, 1981

[51] Int. Cl.[3] ..... A47F 1/00

[52] U.S. Cl. ..... 211/49 D; 211/60 R; 312/71

[58] Field of Search ..... 211/49 D, 51, 60 R, 211/68, 74; 312/45, 42, 71, 72, 73

[56] References Cited

U.S. PATENT DOCUMENTS

| | | |
|---|---|---|
| 12,029 | 12/1854 | Miller . |
| 161,093 | 3/1875 | Blades . |
| D. 252,299 | 9/1979 | Marshall . |
| D. 252.962 | 9/1979 | Wilks . |
| D. 253,213 | 10/1979 | Hudik et al. . |
| 261,731 | 7/1882 | Lane . |
| 529,696 | 11/1894 | Blades . |
| 777,418 | 12/1904 | Hopkins . |
| 905,993 | 12/1908 | Dabney et al. . |
| 1,294,021 | 2/1919 | Abbott . |
| 1,317,534 | 9/1919 | Williams . |
| 1,452,659 | 4/1923 | Seelman . |
| 2,513,595 | 7/1950 | Stewart . |
| 2,799,399 | 7/1957 | Cannon . |
| 3,780,873 | 12/1973 | Silva . |
| 3,848,745 | 11/1974 | Smith . |

FOREIGN PATENT DOCUMENTS

| | | | |
|---|---|---|---|
| 1104110 | 11/1955 | France | 312/42 |
| 1037805 | 8/1966 | United Kingdom | 211/49 D |

*Primary Examiner*—Ramon S. Britts
*Assistant Examiner*—Robert W. Gibson, Jr.
*Attorney, Agent, or Firm*—Frishauf, Holtz, Goodman & Woodward

[57] ABSTRACT

To provide for reliable seating of articles or packages (P) such as lipsticks, small bottles, and the like, and feed of the articles along an inclined chute (15), the chute is positioned at an angle of about 35° and has a forward horizontal or flat portion (19) of such dimension that the bottom wall of the package or article of the foremost package (P1) fits on the flat portion. The articles or packages are maintained in feeding sliding engagement by a roller (18) rolling on the chute, ribs or rails (20, 21) inwardly projecting from the side walls (22, 23) limiting the lateral extent of the chute preventing unauthorized removal of the roller. A front wall (13) prevents forward tipping of the foremost one (P1) of the packages.

6 Claims, 4 Drawing Figures

COMBINATION POINT-OF-SALE DISPLAY AND DISPENSER DEVICE

The present invention relates to a combination display and dispenser device primarily adapted to placement on store counters to permit customers to select goods, and remove them from the device for purchase after having made the selection. The device is particularly suitable for use with elongated tubular-shaped articles, such as cosmetic goods, for example lipsticks, and other long tubular elements in which a color selection is also desirable, permitting association with a group of similar dispensing devices to permit a customer to make a color match.

BACKGROUND

Various types of dispensing devices using inclined tracks for self-feeding of goods have been proposed. If the goods are elongated and tubular, that is, have a longitudinal dimension which is long with respect to the diametrical dimension, they can be fed from an inclined track to roll downwardly. If a customer has made a selection, for example based on a color match, and is displeased with particular selection, and wishes to replace it, rolling contact of the particular goods with a subsequent, automatically fed article is frequently difficult and may result in jamming of the dispenser.

THE INVENTION

It is an object to provide a point-of-sale dispenser and display device in which packages, and particularly packages of elongated tubular form of circular cross section, can be displayed and automatically fed, if a foremost positioned article is removed, while securely holding the articles in stacked alignment, and permitting reintroduction of the articles if a selection previously made by a customer is to be returned to the display device; and which holds the articles securely in aligned position.

Briefly, a frame is provided supporting an inclined chute which extends from an elevated position on the frame downwardly to a forward portion. The chute terminates in a horizontal portion, closed off by a front wall. The front wall holds the article in position on the horizontal portion, so that the foremost article will not be positioned on the inclined slope but, rather, will be seated securely with its bottom wall against the horizontal portion and held in upright position by the front wall. Feed of the articles, which may be light, is obtained by engaging a roller behind the articles, to roll down the chute positioned behind the last one of the articles. Preferably, the chute is so formed that the roller cannot be removed except from behind the frame, to prevent unauthorized and spurious removal thereof. The horizontal portion has a length dimension at least as long as the diameter of the package or article so that it will be firmly supported thereon.

A group of such dispensers can be stacked next to each other, with partitioning side walls limiting the lateral extent of the chutes common to adjacent units. The frame may also be common to the respective individual units. In manufacture, therefore, units can be made with only one side wall and assembled laterally, with the final unit having a closing side wall attached.

The units can be made inexpensively of plastic, either molded, or assembled of bonded or welded plastic strips, to provide a pleasing appearance, permitting ready identification of the goods to be dispensed.

The arrangement has the advantage of being pleasing in appearance, and effectively displaying various types of packages, particularly elongated tubular elements such as cosmetic items, although not being restricted thereto; the goods to be displayed and dispensed are held in secure position and jamming of adjacent goods, particularly if reintroduced by a customer, is effectively prevented.

DRAWINGS

Figure 1:
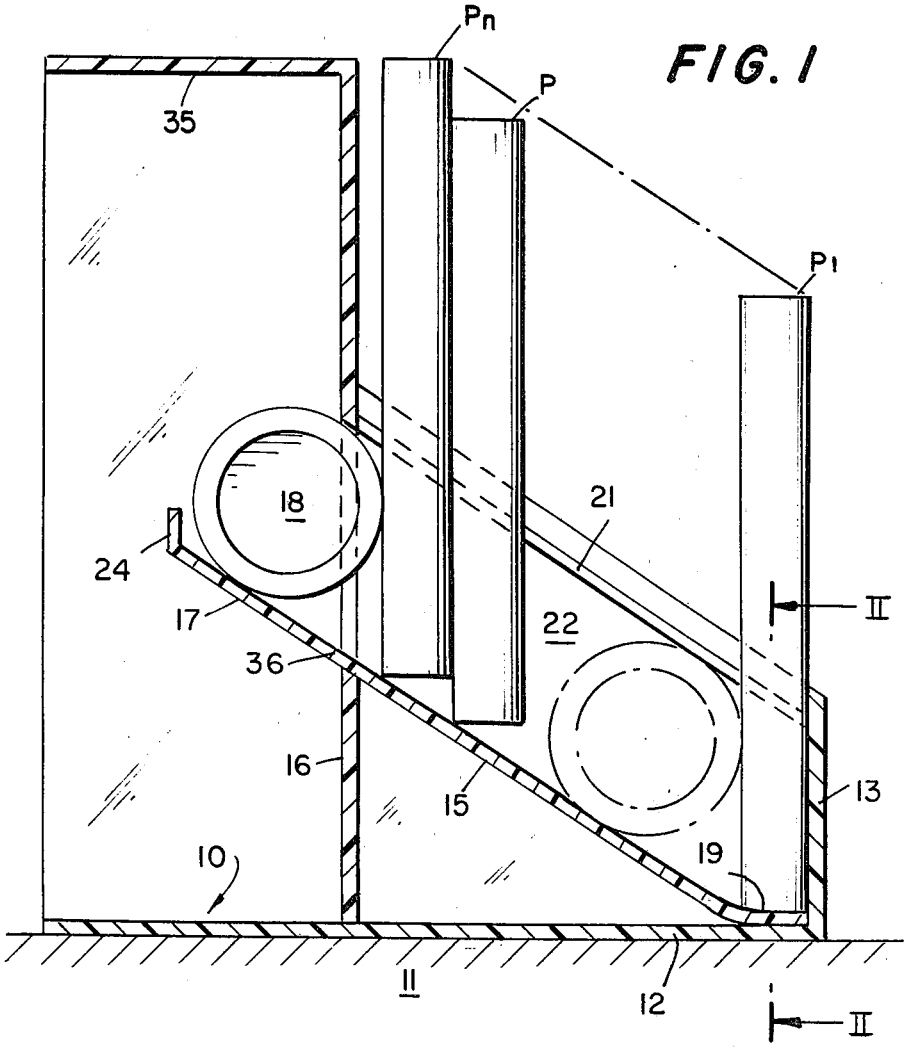
FIG. 1 is a highly schematic side view of an embodiment of the invention, illustrating the dispensing device for use in connection with cosmetic items such as lipsticks; it is assumed that the constructional material is a transparent plastic, so the internal construction is visible.
Figure 2:
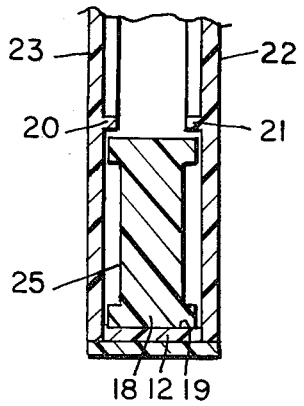
FIG. 2 is a fragmentary cross-sectional view along line II—II of FIG. 1.

The units are made of a base or frame 10 which is adapted to be placed on the support surface, for example a counter top 11. The frame has a forward frame portion 12 which supports a front wall 13, extending upwardly and vertically away from the support surface 11. The frame 10 supports a chute or inclined track 15. The chute or track 15 is angled upwardly at an angle of about 35° with respect to the horizontal forward frame portion 12. The angle of 35° is comparatively critical with respect to the packages P to be dispensed. If the angle is too steep, difficulty is experienced in maintaining the packages in an upright position and parallel to the front wall 13; if too shallow, they may not feed freely. For tubular elongated articles having a length of 7–15 cm, and a diameter of 0.8 to $2\frac{1}{2}$ cm, and having a housing shell made of either metal or plastic, that is, a smooth material, an angle of 35° is suitable and preferred. The chute 15 extends inwardly of an upright dividing wall 16 of the frame, as seen at 17. A roller 18 is placed behind the upright wall 16 to bear against the packages P and feed the packages down the inclined chute upon removal of the frontmost package P1 from the stacked set of packages P. The roller bears against the rearmost package Pn.

Figure 3:
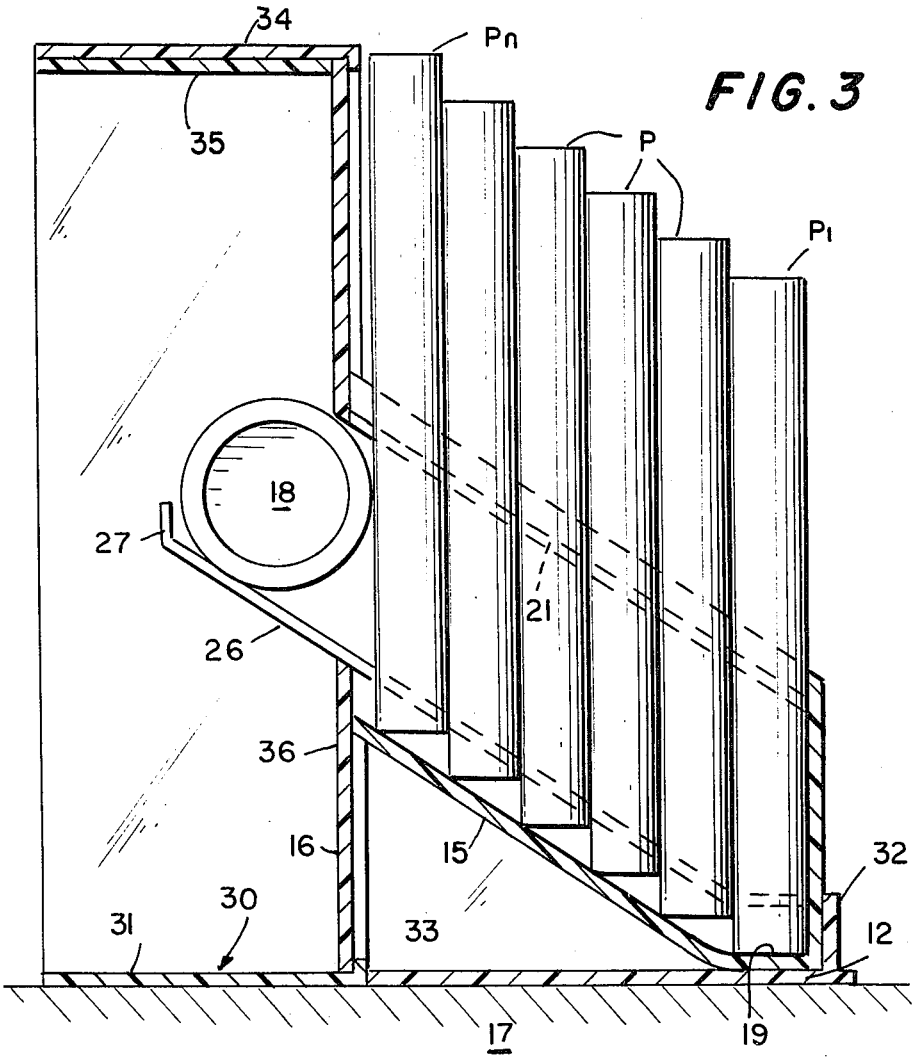
FIG. 3 is a side view, in section, similar to FIG. 1 and illustrating another embodiment.

The forward portion 19 of the chute is horizontal, and parallel to the support 11. As can be seen in FIGS. 1 and 3, the bottom wall of the foremost package P1 stands on and is seated firmly with its entire surface on the flat or horizontal portion 19 of the chute. Thus, the foremost package P1 is retained in position by the front wall 13 while being supported on its stand-up base by the flat surface 19. Even if the bottom wall of the forward package P1 is slightly concave, or relieved, or of ring form, the foremost package P1 is reliably supported by the flat surface 19, and prevented from tipping by the front wall 13.

The roller 18 is guided on the chute 17 by a pair of inwardly projecting guide ribs 20, 21, for example adhered to or molded on or formed on the respective side walls 22, 23 which, preferably, extend to a level of at least about half the height of the articles or goods to be dispensed. The side walls may extend inwardly of the upright wall 6, or only partly adjacent the chute 15, to retain the roller 18 in position. They extend forwardly to the front wall 13, preferably terminating flush therewith. The internally projecting guide ribs 20, 21 preferably terminate inwardly of the upright wall 16. The chute 17 preferably terminates in an upwardly directed end portion 24 to retain the roller 18 in position, even though it may be pushed to the end of chute 15.

Use and operation: A set of packages P, having P1 . . . Pn units, is placed on the chute so that the foremost package P1 is seated on the horizontal surface 19 of the chute. A roller 18 is then inserted in the rear of the upright wall 16, holding the packages in position. The foremost or front package P1 can readily be removed by lifting it out vertically; the subsequent packages will then be fed downwardly by the weight of the roller 18. Reinsertion of a foremost package, if a selection is to be returned to the stack, is possible by pushing the remaining packages backwards against the weight of the roller and re-seating the returned packages in the foremost position.

The roller 18 is preferably made of solid plastic; it may have a relieved center web 25 to facilitate rolling beneath the guide ribs and against the lateral side walls 22, 23, and prevent jamming in case the roller should become slightly skewed.

FIG. 3 illustrates a modification in which the roller 18 is guided by a pair of bottom rails 26 secured to the respective side walls 22, 23, the rails 26 extending parallel to the surface of the chute 15. The rails, prefably, also have a horizontal portion to provide for guidance of the foremost package P1 by the rail at a position upwardly of the horizontal portion 19 of the chute itself. The rails 26 preferably have inwardly upwardly directed ends 27 to hold the roller 18 in position.

A plurality of the display device units of either FIG. 1 or 3 can be assembled together. FIG. 3 illustrates an assembly frame 30 which has a base portion 31 and a forward portion 32 which retains the front wall 13 of a plurality of units together. The base portion 31 is preferably formed with a projecting lip 33 to place the frame upright walls 16 in position. The units are held together at the top by a top cover 34. For stability, the units themselves preferably also have a top wall 35. The top cover 34, as well as the assembly frame 30, can likewise be made of plastic or of a metal stamping. The intersecting position 36 between the chute 15 and upright wall 16 is sufficiently elevated above the bottom wall 10 to incline the chute 15 at the selected angle.

The dispenser is suitable for various goods and articles, for example bottles, cans, plastic sleeves, and the like. It is particularly adapted to feed articles which can readily move by gravity and have smooth surfaces. Rolling contact is maintained only with the roller 18, however. Unauthorized removal of the roller is prevented by the guide ribs 20, 21 of the side walls 22, 23.

Figure 4:
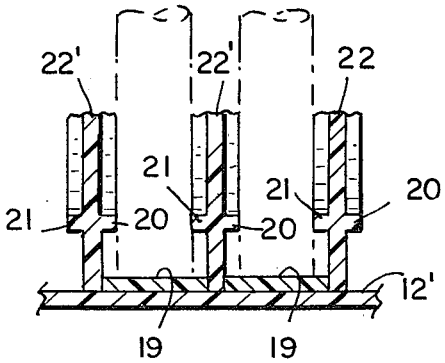
FIG. 4 is a fragmentary sectional view similar to FIG. 2, omitting the roller, and illustrating a plurality of sectional units assembled together.

If a plurality of units are made for assembly on a common base 12' (FIG. 4), the side walls can be common to adjacent units, in which case the side walls 22' will be formed with ribs 20, 21 or rails 26, as the case may be, from both sides thereof. The end walls will then have externally projecting ribs as well, or special walls can be made with smooth outer configuration.

Various changes and modifications may be made, and features described in connection with one of the embodiments may be used with any other, within the scope of the inventive concept. For example, the assembly frame 30 can be constructed in different ways, and the units can be assembled together by lateral adhesion of frame elements 10, connecting bolts, or interlocking projection-and-recess snap-in elements. If the latter is desired, the respective side walls or frame elements can be formed with holes or recesses, and projecting plugs on the other side, which can be either resiliently deflectable or formed with an interference fit. For assembly, the projections are fitted into the recesses and either held therein by an interference fit, by an adhesive, or by resilient deformation. At the final unit, the projections can then be snapped off if a smooth outline is desired.

I claim:

1. A combination point-of-sale display and dispenser device for elongated cartridge-like packages (P) comprising a support frame (10) adapted for positioning on a horizontal support surface (11);

an inclined chute (15) extending from an elevated position (36) of the frame downwardly to a forward portion (12) of the frame;

a horizontal portion (19) formed at the forward end of the chute and having a dimension which is at least as great as the diameter of the packages to permit seating of the bottom surface of the foremost package on said horizontal portion;

side walls (22, 23) positioned adjacent the chute and extending laterally adjacent thereof to retain the packages on the chute;

a front wall (13) extending vertically from the forward portion of the frame (12) and holding the foremost package in vertically extending position;

a roller (18) positioned on said chute adapted to press against the rearmost package (Pn) of a set of packages positioned on the chute and to push the packages forwardly to said horizontal portion, and move the set of packages forwardly upon removal of the foremost package (P1) from the chute;

and retaining means (20, 21) constricting the space between the side walls (22, 23) and positioned over said roller to prevent removal of the roller (18) from the chute.

2. Device according to claim 1, wherein the roller retaining means comprise ridges (20, 21) projecting from the side walls and facing each other at the inclined portion of the chute.

3. Device according to claim 1, wherein the frame is formed with a vertical upright wall portion (16) to form a back-up support for the rearmost package (Pn) of the set of packages;

and the inclined portion of the chute (15) has an unobstructed chute back portion (17) extending beyond the upright wall (16) rearwardly thereof to permit insertion of the roller into the chute.

4. Device according to claim 1, wherein the side walls (22, 23) are formed with projecting rails (26) projecting towards each other and extending parallel to and above the chute to form running rails for the roller (18) and provide for engagement of the roller with the packages (P) intermediate the length dimension of the packages.

5. Device according to claim 1 or 2 or 3 or 4, wherein the angle of inclination of the chute (15) is in the order of 35°.

6. A combination point-of-sale display and dispenser assembly comprising a plurality of the devices as claimed in claim 1 positioned adjacent each other, wherein the forward portions (12') of the frame include a unitary element common to said devices;

and wherein the side walls (22, 23) of adjacent units are single elements (21') common to adjacent units.

* * * * *